US005403102A

United States Patent [19]

Yokoyama

[11] Patent Number: 5,403,102

[45] Date of Patent: Apr. 4, 1995

[54] LED HEAD FIXTURE AND LED HEAD USING THE SAME

[75] Inventor: Manabu Yokoyama, Kyoto, Japan

[73] Assignee: Rohm Co., Ltd., Kyoto, Japan

[21] Appl. No.: 200,878

[22] Filed: Feb. 22, 1994

Related U.S. Application Data

[63] Continuation of Ser. No. 994,296, Dec. 21, 1992, abandoned.

[30] Foreign Application Priority Data

Dec. 27, 1991 [JP] Japan ..... 3-345685

[51] Int. Cl.[6] ..... B41J 1/50

[52] U.S. Cl. ..... 400/175; 400/692; 362/418; 347/238

[58] Field of Search ..... 400/320, 175, 692; 355/229; 362/418, 800, 410, 426, 429; 346/160

[56] References Cited

U.S. PATENT DOCUMENTS 4,410,288 10/1983 Holmes, Jr. ..... 400/175
4,455,594 6/1984 Yang ..... 362/418
4,576,494 3/1986 Smith ..... 400/175
4,576,496 3/1986 Schwarz et al. ..... 400/320
4,708,502 11/1987 Murakami ..... 400/320
5,092,693 3/1992 Uchimura ..... 400/320
5,152,620 10/1992 Gomoll et al. ..... 400/175
5,218,383 6/1993 Kondou et al. ..... 362/418

*Primary Examiner*—Edgar S. Burr
*Assistant Examiner*—John S. Hilten
*Attorney, Agent, or Firm*—Fish & Richardson

[57] ABSTRACT

With the aid of a fixture, a lens holder for holding on the top surface thereof a lens array radiating outwardly a light emitted from an array of LED elements is secured to a support plate for supporting the lens holder on the top surface thereof. The fixture comprises a bottom portion having a upwardly swelling central section and serving as a leaf spring, side portions extending upward from both sides of the bottom portion, and engagement portions formed by being acutely folded and extending diagonally inward to mate with the upper side edges of the body of the LED head. The fixture is allowed to be slidably displaceable with respect to the LED head body.

7 Claims, 5 Drawing Sheets

LED HEAD FIXTURE AND LED HEAD USING THE SAME

This application is a file wrapper continuation of U.S. application Ser. No. 07/994,296, filed Dec. 21, 1992, now abandoned.

BACKGROUND OF THE INVENTION

1. Field of the Invention

The present invention relates to an LED head for use in a printer, plotter, facsimile, optical character writing apparatus, or the like.

2. Description of the Related Arts

A conventional LED head is shown in FIGS. 1 and 2. As is apparent from these figures, the LED head comprises a body including a lens holder having therein a circuit substrate on which an array of LED elements for light emission is mounted and holding a longitudinal lens array for outwardly directing the light from the array of the LED elements; and a radiating plate (supporting member) 3 for fixedly supporting the lens holder. In this LED head, pawls 4 are provided on the lens holder 2 for fixing the lens holder 2 to the radiating plate 3. Furthermore, the lens holder 2 and the radiating plate 3 are surroundingly supported by a metal fixture 5 having a substantially U-shaped configuration in lateral view and including open edges 5*a* and 5*c* having in the vicinity of their ends holes 6*a* and 6*c*, respectively. The pawls 4 are fitted into the holes 6*a* and 6*c*, thereby joining the lens holder 2 to the radiating plate 3.

In the above-described known LED head, the pawls to be mated with the holes are fixedly provided at a predetermined position, and hence the position of the fixture to be mounted and the number thereof is also fixed. It is therefore impossible to increase them depending on the conditions or applications, and to fit the metal fixture therewith in case of breakage of the pawls.

SUMMARY OF THE INVENTION

The present invention was conceived in view of the above problems, and the object of which is to provide an LED head allowing a free setting of the location of the fixture to be mounted and the number thereof while reducing the damage to which components may be otherwise subjected at the time of attachment or detachment.

A fixture for an LED head according to the present invention adapted to surround a bottom surface and opposing side surfaces of a rectangular parallelepiped body of the LED head for holding the body, comprises:

- a bottom portion having an upwardly swelling central section and acting as a leaf spring;
- side portions extending upward from both edges of the bottom portion; and
- engagement portions formed by being acutely folded at the upper ends of the side portions and extending diagonally inwardly to engage with upper side edges of the body of the LED head.

In this manner, the fixture for the LED head is allowed to engage with the body of the LED head by way of the engagement portions, thereby enabling the fixture for the LED head to be freely displaced along the side portions of the body of the LED head. This permits a free setting of the number of the fixture and the position for the fixture to be mounted.

Also, the fixture for the LED head is preferably made of a metallic material, thereby enduring a sufficient resiliency and a secure holding of the body of the LED head.

Moreover, in an LED head having a rectangular pallelepiped LED head body and an LED head fixture for holding the LED head body according to the present invention, the LED head body includes:

- a lens array which radiates outwardly a light emitted from the array of the LED elements;
- a lens holder for holding the lens array on the top surface thereof; and
- a supporting plate for supporting the lens array on the top surface thereof, and the LED head fixture includes:

- a bottom portion having an upwardly swelling central section and serving as a leaf spring;
- side portions upwardly extending from side edges of the bottom portion; and
- engagement portions formed by being acutely folded at the top ends of the side portions and diagonally inwardly extending to engage with the opposing edges of the top surface of the LED head body, the LED head fixture being slidably displaceable with respect to the LED head body.

Preferably, the LED head body includes at its upper edges a protrusion having a triangular configuration in section and adapted to mate with the engagement portion, thereby securely holding the engagement portion of the LED head fixture.

Preferably, a plurality of the LED head fixtures are secured to the LED head body.

Preferably, the lens array emits a light upward.

DESCRIPTION OF THE PREFERRED EMBODIMENTS

The present invention will now be described in more detail based on embodiments thereof.

Figure 3:
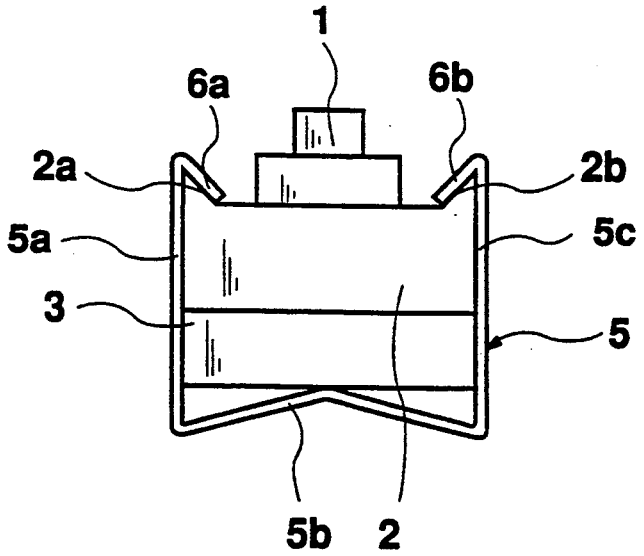
FIG. 3 is a side elevational view of an LED head showing an embodiment of the present invention.
Figure 4:
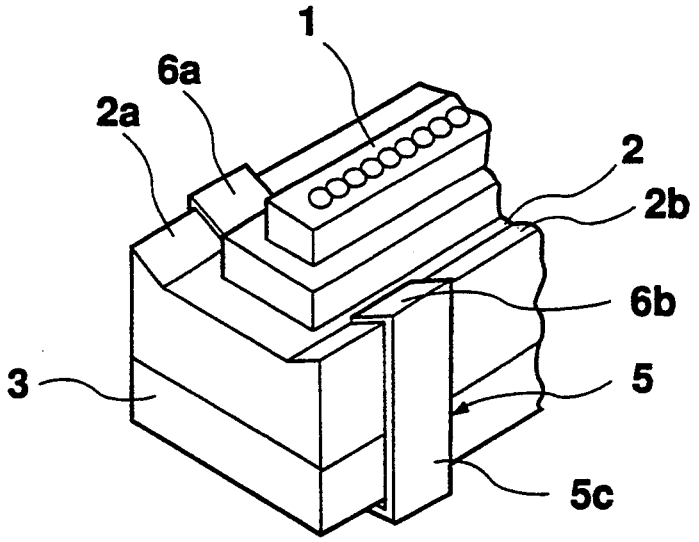
FIG. 4 is a partly perspective view of the LED head embodiment.

FIG. 3 is a side elevational view of an LED head showing an embodiment of the present invention, and FIG. 4 is a partial perspective view of the LED head of the same embodiment.

Figure 1:
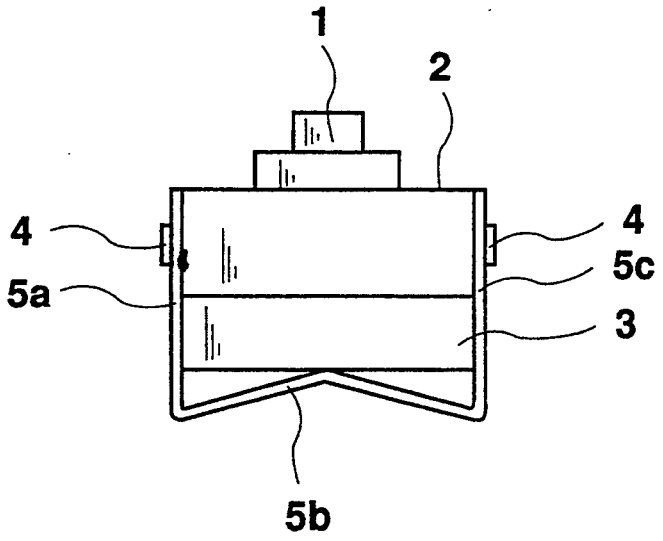
Fig. 1 ( PRIOR ART )
FIG. 1 is a side elevational view showing a conventional LED head.
Figure 2:
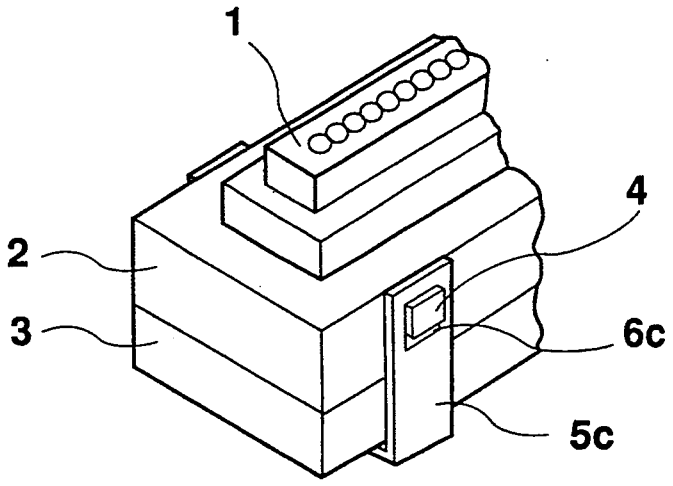
Fig. 2 ( PRIOR ART )
FIG. 2 is a partial perspective view of the conventional LED head.

The LED head embodiment comprises a lens holder 2 for holding a lens array 1 as a body of the LED head, and a radiating plate 3 serving as a support for fixedly supporting the lens holder 2. The lens holder 2 includes at its lower portion a circuit substrate not shown on which an array of LED elements and a drive circuit are mounted. The lens holder 2 and the radiating plate 3 are integrally secured to the LED head by means of a metal fixture 5. It is to be noted that the above-described structure is the same as that of the conventional type shown in FIGS. 1 and 2.

The LED head embodiment is characterized by a metal fixture 5 having substantially U-shaped configuration consisting of edges 5*a*, 5*b* and 5*c* when viewed from the side thereof. The metal fixture 5 further includes folded pieces 6*a* and 6*b* directed toward the edge 5*b* and receiving longitudinal upper outwardly raised edges 2*a* and 2*b* of the lens holder 2 as shown in FIG. 4, thereby ensuring a secure integral fixation of the lens holder 2 to the radiating plate 3. In addition, the metal fixture 5 is freely displaced in the direction indicated by an arrow A, and any number of metal fixtures 5 are available.

Figure 5:
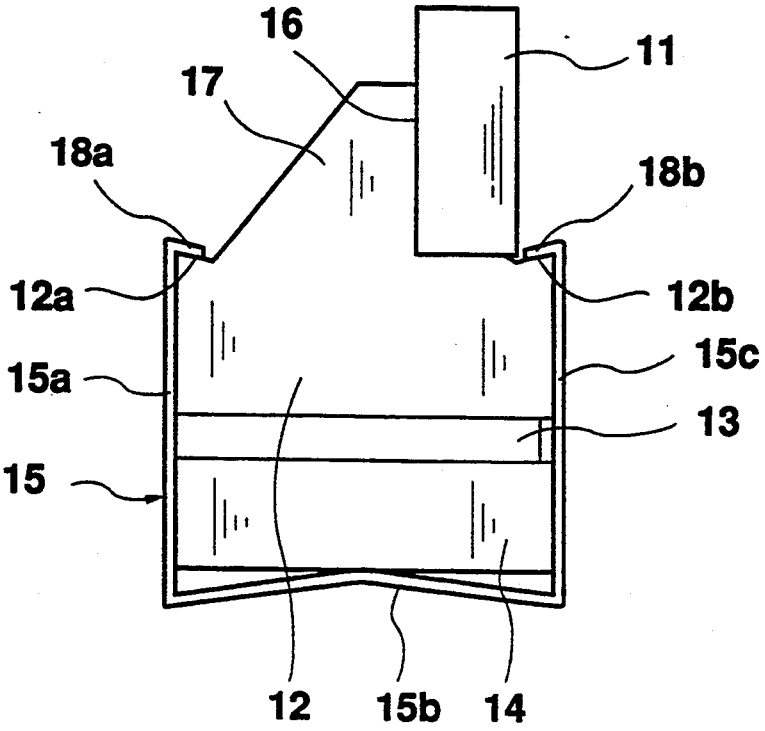
FIG. 5 is a side elevational view of the LED head showing another embodiment of the present invention.
Figure 6:
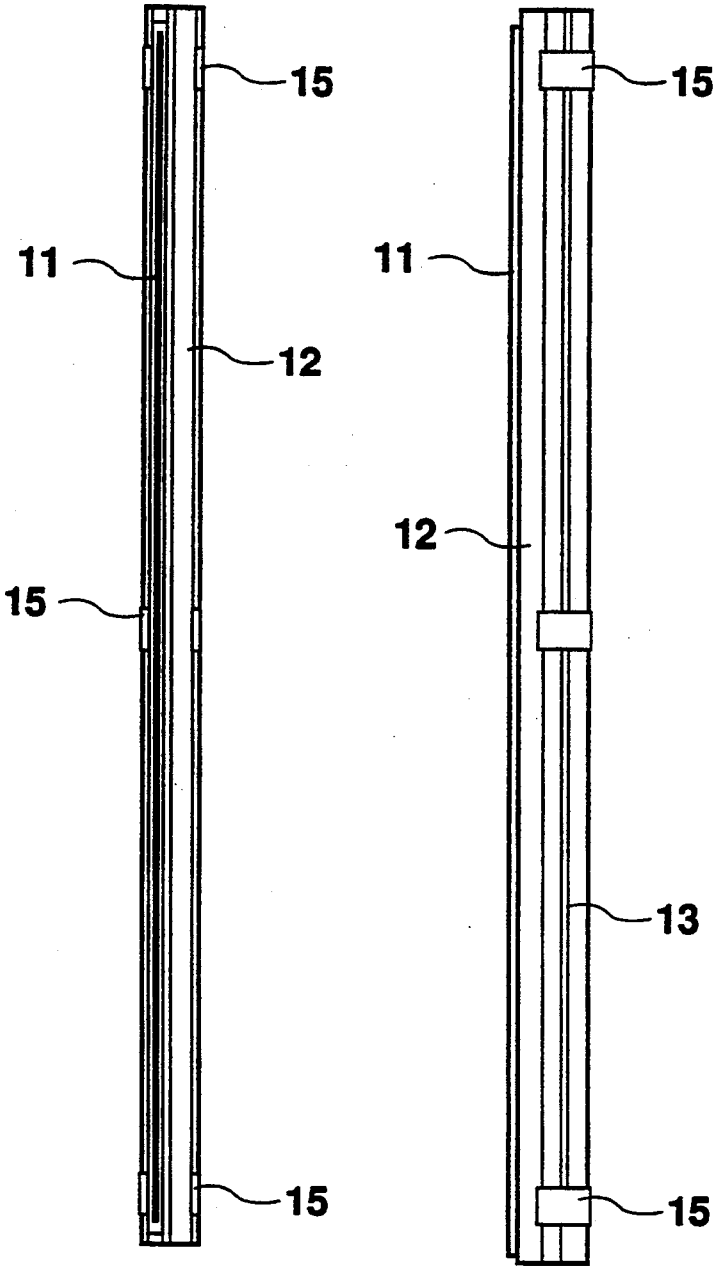
FIG. 6 is a top plan view and a front elevational view of the LED head embodiment, respectively.

FIG. 5 is a side elevational view of a LED head showing another embodiment of the present invention. FIG. 6*a* is a top plan view of the LED head, while FIG. 6*b* is a front elevational view of the LED head.

This LED head embodiment comprises a lens array 11, a lens holder 12 for holding the lens array 11, a circuit substrate 13 on which an array of LED for light emission and the drive circuit are mounted, a radiating plate 14 joined to the circuit substrate 13, and a metal fixture 15 for integrally binding the lens holder 12, the circuit substrate 13 and the radiating plate 14.

The lens holder 12 includes an elongated rectangular opening, a protrusion 16 extending upward to define a vertical wall 16, and longitudinal outwardly raised edges 12*a* and 12*b* in the same manner as shown in FIGS. 3 and 4. Although not shown in the figures, the lower ends of lenses constituting the lens array 11 confront the array of LED elements placed on the circuit substrate 13 through the opening of the lens holder 12.

The metal fixture 15 to be used in this embodiment is the same as the metal fixture 5 shown in FIGS. 3 and 4.

Although three metal fixtures 15 are used in this embodiment, further additional fixtures may be properly provided.

In particular, the realization of miniaturization in the lens holder may inevitably lead to a smaller thickness of the constituent members, which possibly impairs the rigidity of the lens holder. This in turn may adversely affect the optical and mechanical liniarity of the lens array with respect to the array of the LED elements. In this case, the number the metal fixtures may be increased to supplement the deficiency in the rigidity of the holder.

Besides, the metal fixtures used in the above embodiments are literally made of metallic material, but instead resin or other material is also applicable as long as proper strength and resiliency can be ensured.

Figure 7:
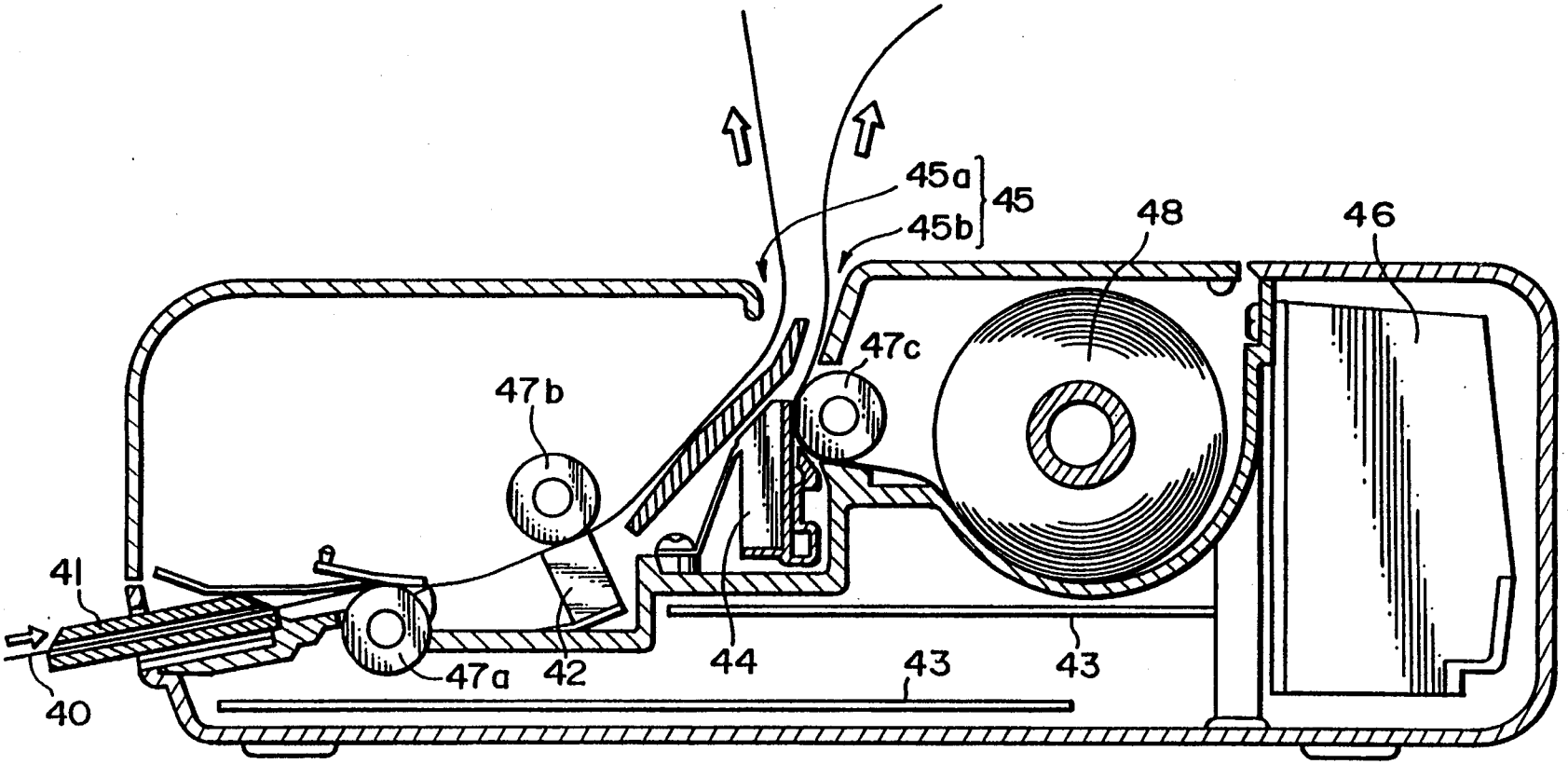
FIG. 7 is a fragmentary cross-sectional view of a facsimile machine equipped with an image sensor having the LED head.

FIG. 7 shows the internal structure of a facsimile machine in which the image sensor having the foregoing LED head and a light-receiving device is mounted.

The facsimile machine includes: a document supplier 41; an image sensor 42 as an image reader; a base plate 43 having a controller for controlling transmission, reception and the whole facsimile; a printer 44; a document discharger 45; and a power source 46.

In operation, when a document 40 is supplied from the document supplier 41, it is conveyed by platen rollers 47*a*, 47*b*. At that time, light emitted from the LED head and reflected by the document is received by the light-receiving device so that the image of the document is ready by the image sensor 42, and then the image sensor 42 outputs the image information in the form of electrical signals to the controller. The electrical signals inputted to the controller are then transmitted to the distant destination via a telephone line or the like. The document whose image has been completely read will then be discharged from the document discharger 45*a*.

Further, when the controller receives the signals transmitted from outside, it controls the printer 44 to print the received image on a printing paper 48. The printed paper 48 will then be discharged from the document discharger 45 by the platen roller 47*c*.

What is claimed is:

1. A fixture for a LED head adapted to surround a bottom surface and opposing side surfaces of a rectangular parallelepiped body of the LED head for holding the body comprising:

a bottom portion having two side edges and an upwardly swelling central section forming a leaf spring;

side portions extending upward from both side edges of said bottom portion and having upper end portions; and an engagement portion formed at the upper end portion of said side portions, each of said engagement portions comprising a folded member extending diagonally inwardly at an acute angle from said upper end portion of one of said side portions to engage with upper side edges of the body of the LED head, such that said upper side edges are biased against said engagement portions by said leaf spring.

2. A fixture for a LED head according to claim 1, wherein said fixture for a LED head is made of a metallic material.

3. An LED head having a rectangular parallelepiped LED head body, said LED head body having a top surface, said top surface having opposing edges, and an LED head fixture for holding said LED head body, said LED head body including:

a lens array;

a lens holder for holding said lens array on a top surface thereof; and a supporting plate for supporting the lens array on a top surface thereof;

said LED head fixture including:

a bottom portion having two side edges and an upwardly swelling central section forming a leaf spring;

side portions extending upward from both side edges of said bottom portion and having upper end portion; and an engagement portion formed at the upper end portion of said side portions, each of said engagement portions comprising a folded member extending diagonally inwardly at an acute angle from said upper end portion of one of said side portions to engage with the opposing edges of the top surface of the LED head body, said LED head fixture being slidably displaceable with respect to said LED head body, and said opposing edges of the top surface of said LED head body being biased against said engagement portions by said leaf spring.

4. An LED head according to claim 3, wherein said LED head body has upper edges, and includes at said upper edges a protruding portion having a triangular configuration in section for mating with said engagement portion.

5. An LED head according to claim 4, wherein a plurality of said LED head fixtures are secured to the LED head body.

6. An LED head according to claim 5, wherein said lens array emits a light upward.

7. An electronic device having an LED head for applying light to an objective, said LED head including;

a rectangular parallelepiped LED head body and an LED head fixture for holding said LED head body, said LED head body including;

a lens array;

a lens holder for holding said lens array on a top surface thereof; and a supporting plate for supporting the lens array on a top surface thereof;

said LED head fixture including:

a bottom portion having two side edges and an upwardly swelling central section forming a leaf spring;

side portions extending upward from both side edges of said bottom portion and having upper end portions; and an engagement portion formed at the upper end portion of said side portions; each of said engagement portions comprising a folded member extending diagonally inwardly at an acute angle from said upper end portion of one of said side portions to engage with the opposing edges of the top surface of the LED head body, said LED head fixture being slidably displaceable with respect to said LED head body, and said opposing edges of the top surface of said LED head body being biased against said engagement portions by said leaf spring.

* * * * *